US006164692A

United States Patent [19]

Takeuchi

[11] Patent Number: 6,164,692

[45] Date of Patent: Dec. 26, 2000

[54] BAG FOR INFLATABLE BELT

[75] Inventor: Hiroyuki Takeuchi, Shiga, Japan

[73] Assignee: Takata Corporation, Tokyo, Japan

[21] Appl. No.: 09/328,289

[22] Filed: Jun. 9, 1999

[30] Foreign Application Priority Data

Jun. 9, 1998 [JP] Japan ..... 10-160777

[51] Int. Cl.[7] ..... B60R 21/18

[52] U.S. Cl. ..... 280/733

[58] Field of Search ..... 280/733, 741

[56] References Cited

U.S. PATENT DOCUMENTS 5,282,648 2/1994 Peterson ..... 280/733

5,839,753 11/1998 Yaniv et al. ..... 280/733

*Primary Examiner*—Kenneth R. Rice

*Attorney, Agent, or Firm*—Foley & Lardner

[57] ABSTRACT

A bag for an inflatable belt of the present invention is a bag having for an inflatable belt capable of being inflated and has a fabric sewn in an envelope-like configuration which is woven with yarns of 315 denier or less. Using the yarns of 315 denier or less ensures that the bag is significantly thin and has excellent smoothness. According to the present invention, it is preferable that the yarns each be made of thermoplastic synthetic filaments of 3.5 denier or less. The bag for the inflatable belt thus is sufficiently thin and has excellent smoothness thus ensuring the excellent deployment of the bag for the inflation of an inflatable belt.

10 Claims, 6 Drawing Sheets

BAG FOR INFLATABLE BELT

BACKGROUND OF THE INVENTION

1. Field of the Invention

The present invention relates to a bag for an inflatable belt of an inflatable belt device for protecting a vehicle occupant during a vehicle collision, wherein the bag is arranged in a portion of a seat belt and can be inflated with gas introduced from a gas generator.

2. Description of the Related Art

An inflatable belt device of this type has been developed by the present applicant and is disclosed in Japanese Patent Application H09-236903. The device includes an inflatable belt capable of being inflated and a gas generator for supplying gas into the inflatable belt to inflate it. The inflatable belt includes a bag folded in a band-like configuration and a cover enclosing the bag. The cover is hard to stretch in the longitudinal direction of the inflatable belt and is able to stretch in the width direction of the inflatable belt. In addition, when the inflatable belt inflates, the length of the cover in the longitudinal direction shrinks due to the stretching of the cover's width.

This inflatable belt device is shown in FIGS. 4(*a*)–6(*d*). As shown in FIGS. 4(*a*) and 4(*b*), the passenger protective device includes a shoulder belt 2 extending diagonally from the right side to the left side of a passenger, a lap belt 3 extending from the right side to the left side of the passenger, a buckle 4 fixed to, for example, a vehicle floor, a tongue 5 to be inserted into and engaged with the buckle 4 when the passenger wears the belt, and an intermediate guide 6 for guiding the shoulder belt 2.

The shoulder belt 2 includes a normal webbing 2A, which is the same as a typical conventional seat belt, and an inflatable belt 2B connected to an end of the webbing 2A. The webbing 2A is slidably hung in the intermediate guide 6. The other end of the webbing 2A is connected to a shoulder belt retractor 7 with an emergency locking mechanism (ELR), which is fixed to the vehicle body. The webbing 2A is arranged such that it is wound into the shoulder belt retractor 7.

The inflatable belt 2B is positioned so that it contacts the passenger and is connected to the tongue 5 at an end opposite to the end connected to the webbing 2A. The lap belt 3 is composed of a normal webbing, which is the same as a typical conventional seat belt, having one end is connected to the tongue 5 and the other end connected to a lap belt retractor 8 (ELR), which is fixed to the vehicle body. A gas generator 9 is connected to the buckle 4. The gas generator 9 is actuated in emergency situations, e.g., vehicle collisions, to generate high-pressure gas. The tongue 5 and the buckle 4 are each provided with passages for introducing gas from the gas generator 9 into the inflatable belt 2B.

As shown in FIG. 5(*a*) through FIG. 6(*d*), the inflatable belt 2B includes a bag 10 and a cylindrical knit cover 12 enclosing the bag 10. The bag 10 is shaped such that that the parts corresponding to the chest and abdomen of the occupant are wider than the other parts. As shown in FIG. 5(*b*), the wider part is folded to shape the bag 10 into a long band-like configuration and the bag is sewn such that there is a stitching seam 11.

The knit cover 12 is supplely stretchable in its width direction, but is hard to stretch in the longitudinal direction of the belt.

The inflatable belt 2B and the lap belt 3 are connected to a tongue 5. The knit cover 12 is connected to both the webbing 2A and the tongue 5 and is designed to withstand a tension load applied to the inflatable belt.

When the gas generator 9 is actuated while the tongue 5 is latched to the buckle 4, the inflatable belt 2B is inflated. During inflation, the knit cover 12 shrinks in the longitudinal direction so that the length of the inflatable belt 2B is shortenedand the inflatable belt 2B thus becomes in close contact with the occupant, thereby securely protecting the occupant.

In the inflatable belt device, as the gas generator is actuated to inflate the inflatable belt, the cover is also inflated. Because the cover is hard to stretch in the longitudinal direction of the inflatable belt, the length of the cover is shortened during its inflation. As a result, the length of the inflatable belt is shortened so that the inflatable belt strongly fits the occupant. Therefore, the occupant can be securely protected.

Such a bag of an inflatable belt device should have a sufficiently small thickness in the folded state; i.e., it should be thin itself, and should be very smooth to minimize the frictional resistance with the knit cover during deployment of the inflatable belt and to enable the belt to deploy smoothly so that the belt inflates quickly.

SUMMARY OF THE INVENTION

Accordingly, it is an object of the invention to provide a bag for an inflatable belt that is thin and is very smooth such that the bag deploys very effectively when the inflatable belt is being inflated.

A preferred embodiment of the invention intended to accomplish the foregoing object includes a bag having a fabric woven with yarns of 315 denier or less and preferably with yarns including thermoplastic synthetic filaments of 3.5 denier or less.

Additional objects and advantages of the invention will be set forth in the following description of the preferred embodiments and, in part, will be obvious from the description or through practicing the invention. The objects and advantages may be realized through the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and, together with the above general description and the following detailed description, serve to explain the principles of the invention.

DETAILED DESCRIPTION OF THE PREFERRED EMBODIMENTS

Figure 1:
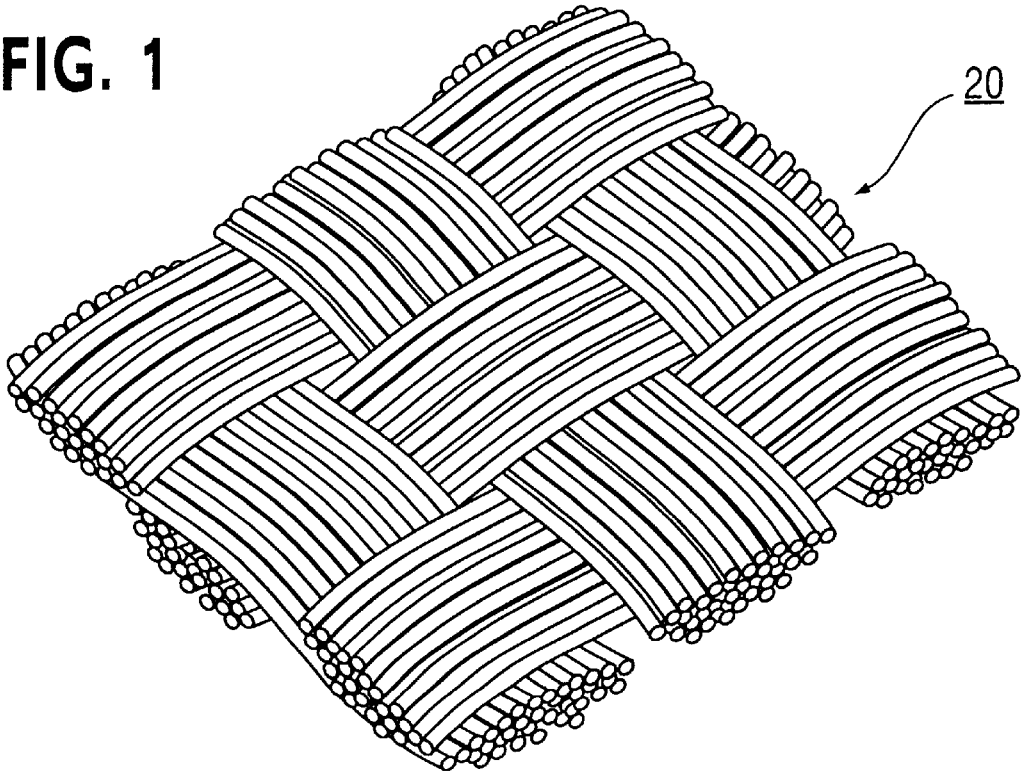
FIG. 1 is a view demonstrating the weave pattern of a fabric of a bag for an inflatable belt of the present invention.
Figure 2A:
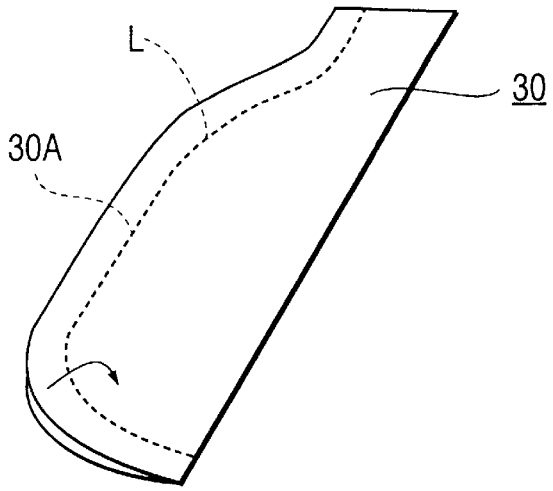
FIGS. 2(*a*) through 2(*c*) are perspective views illustrating an example of a method of folding the bag of the inflatable belt of the present invention, and FIG. 2(*d*) is a sectional view taken along a line D—D in FIG. 2(*c*).
Figure 2B:
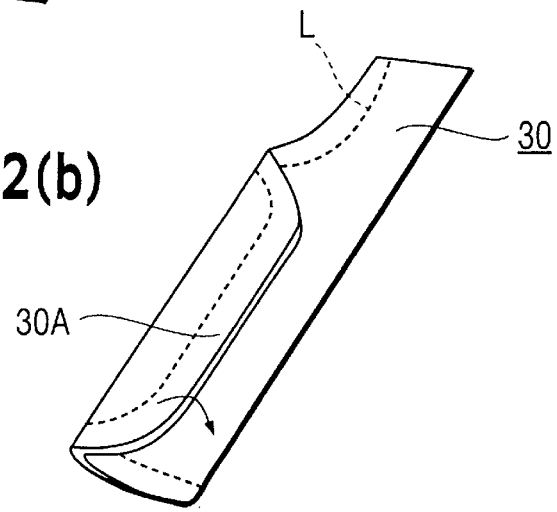
Figure 2C:
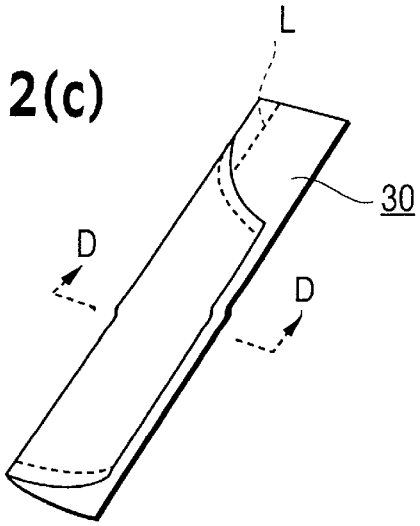
Figure 2D:
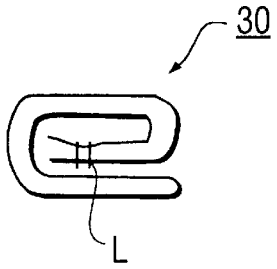

Referring now to the Figures and initially to FIG. 1, there will be seen the fabric 20 for an the bag of an inflatable belt according to the invention. Preferably, the bag for the inflatable belt of the present invention is made of yarns of 315 denier or less so that it is thin and very smooth. When yarns exceeding 315 denier are employed, the fabric of the bag becomes too thick, resulting in less than ideal deployment of the inflatable belt. On the other hand, if the yarns are too fine, the strength of the bag may be impaired. The preferable yarn, therefore, should be less than 315 denier, but greater than 100 denier. The more preferable range is between 210 and 315 denier.

According to the present invention, the yarns for the fabric of the bag may also be preferably made of thermoplastic synthetic filaments in a range from 2.0 denier to 3.5 denier. Each of the yarns is formed by collecting 60–100 of the filaments so as to have 210–315 denier. As mentioned above, yarn having fine filaments is used to improve the flatness of the yarn. As a result, the fabric 20 is very smooth and quite thin, for example, having a thickness of 0.20–0.25 mm.

The bag for the inflatable belt is made from fabric that is thin and smooth. Thus, the bag for the inflatable belt can be folded in a manner ensuring easy and proper deployment, taking into account its manner of deployment. For example, as shown in FIG. 2(*a*), in case of a bag 30 having stitching L and a projecting margin 30A, the bag may be folded into three layers by rolling up the margin 30A. That is, the margin 30A is folded over as shown in FIG. 2(*b*) such that about one-third of the total width of the bag 30 is not covered by the folded portion. The fold of the folded portion is then folded over such that the folded edge is substantially even with the edge of the bag 30 as shown in FIGS. 2(*c*) and 2(*d*).

Figure 3C:
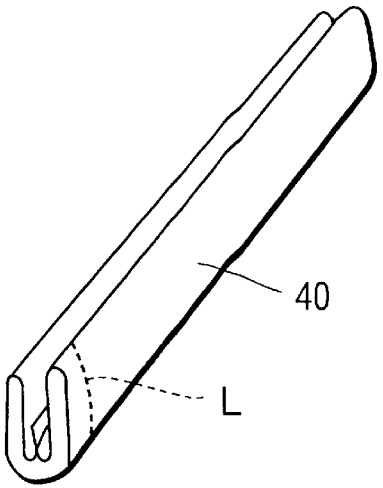
FIGS. 3(*a*) through 3(*c*) are perspective views illustrating another example of a method of folding the bag of the inflatable belt of the present invention.
Figure 3B:
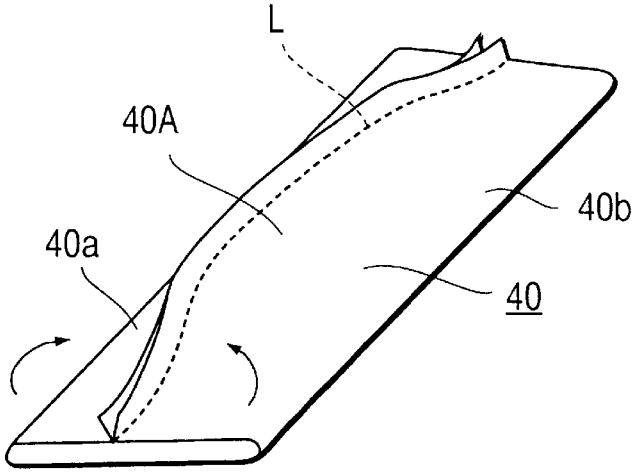
Figure 3A:
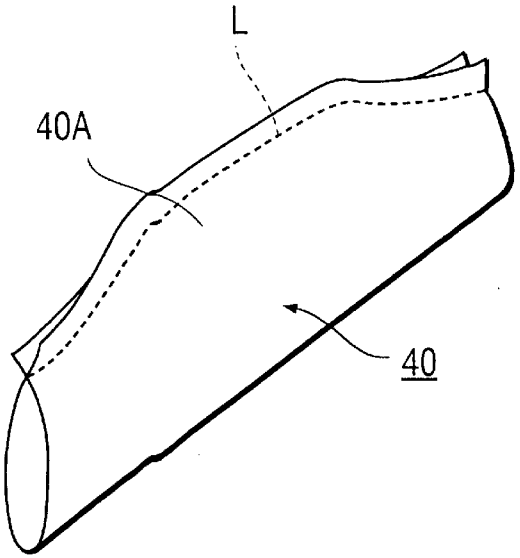
Figure 4B:
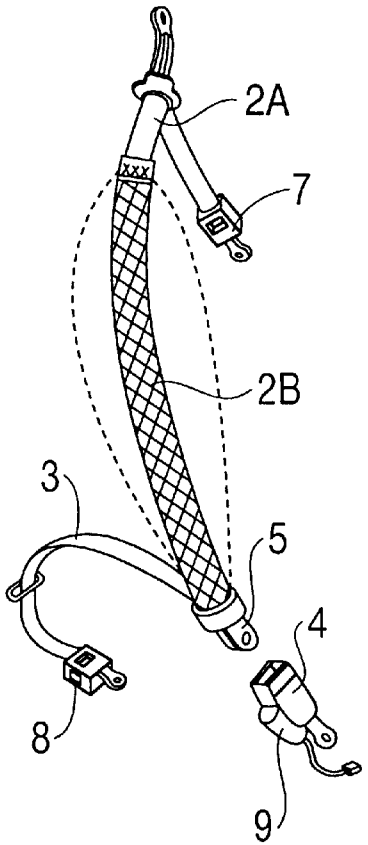
FIGS. 4(*a*) is a perspective view of the inside of a vehicle equipped with an inflatable belt device, and FIG. 4(*b*) is a perspective view showing this inflatable belt device.
Figure 4A:
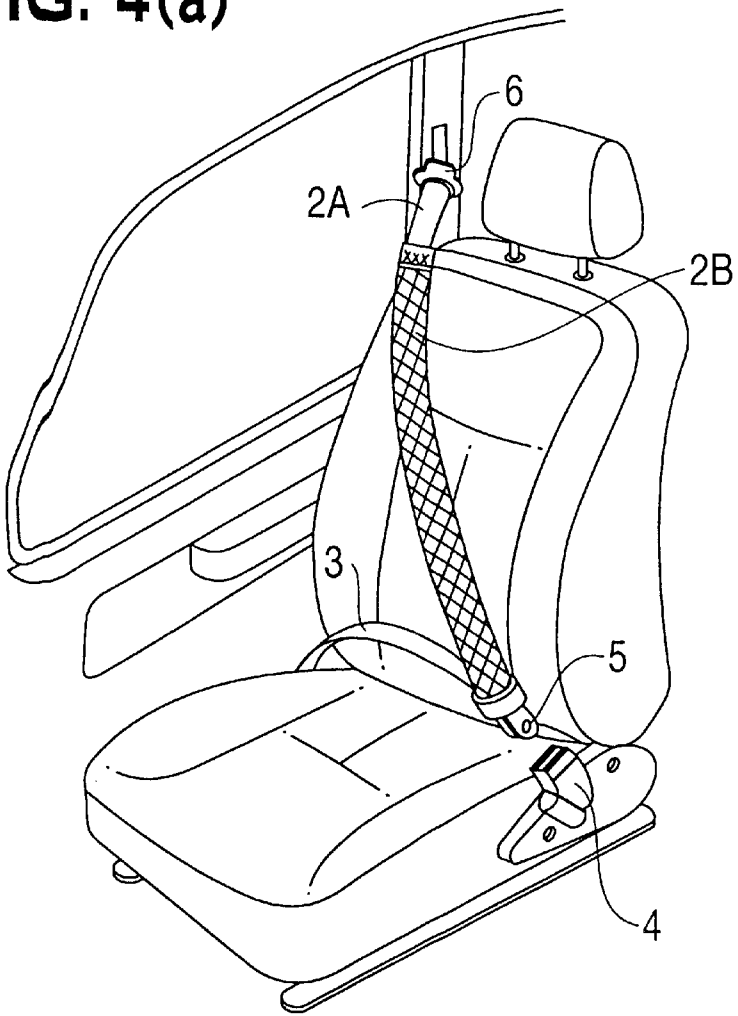
Figure 5A:
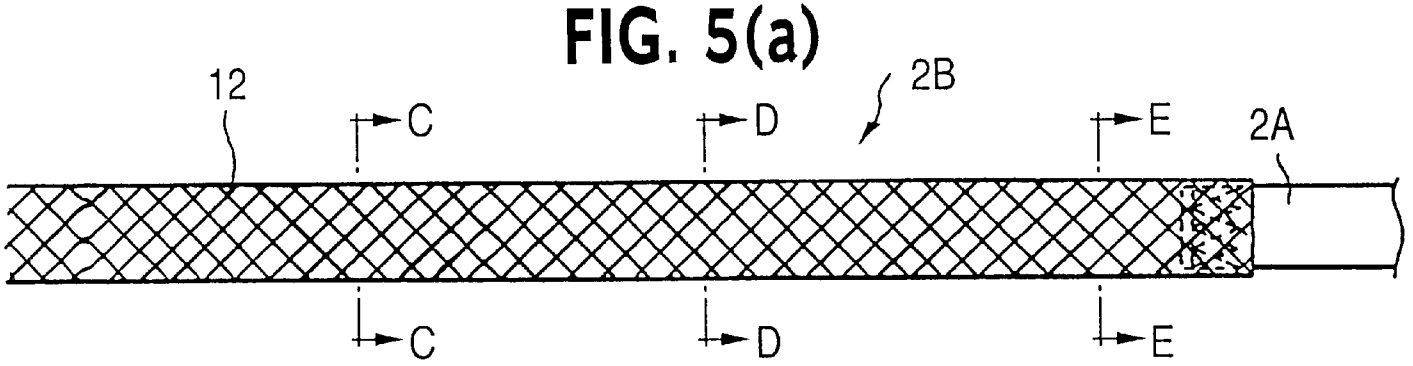
FIG. 5(*a*) is a plan view of a portion around the connection between a shoulder belt and an inflatable belt, FIG. 5(*b*) is a plan view of a folded bag, FIGS. 5(*c*), 5(*d*), and 5(*e*) are sectional views taken along lines C—C, D—D, and E—E in FIG. 5(*a*), respectively.
Figure 5B:
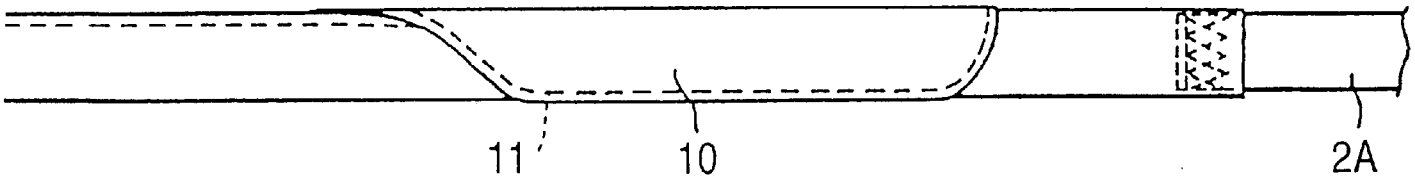
Figure 5E:
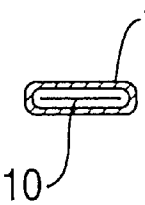
Figure 5D:
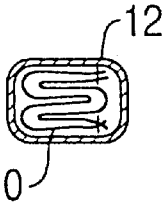
Figure 5C:
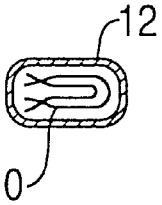
Figures 6A, 6B, 6C, 6D:
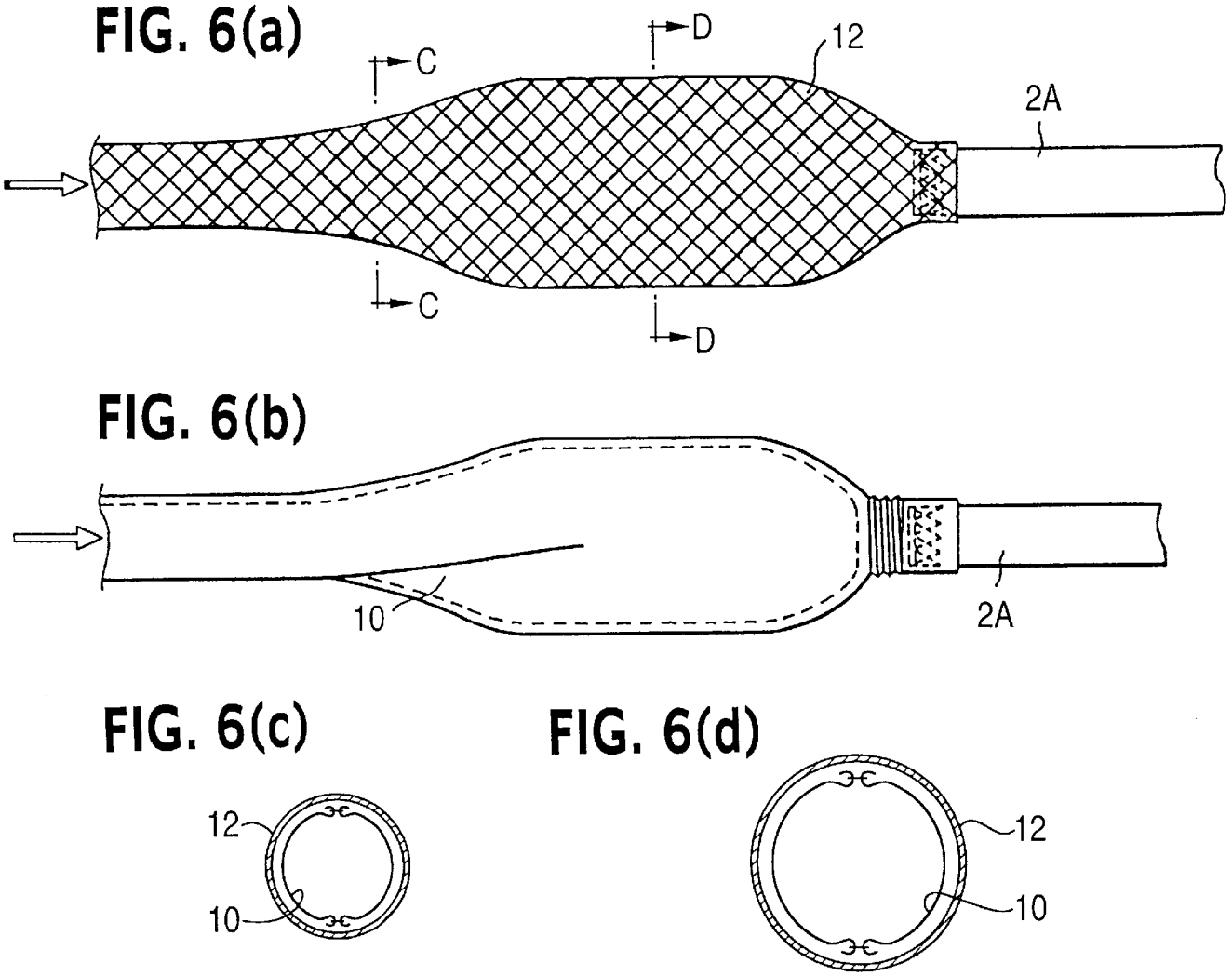
FIG. 6(*a*) is a plan view of a shoulder belt in a state where the inflatable belt is inflated, FIG. 6(*b*) is a plan view of the bag in the inflated state, FIGS. 6(*c*) and 6(*d*) are sectional views taken along lines C—C and D—D in FIG. 6(*a*).

Further, for example, in the case of a cylindrical bag 40 having stitching L and a margin 40A as shown in FIG. 3(*a*), the bag 40 is first spread flat as shown in FIG. 3(*b*) such that the margin extends perpendicularly upward from the flat part. Each side 40*a*, 40*b* is then folded upward such that the margin 40A is sandwiched by the sides 40*a*, 40*b*. Last, an end portion of the folded bag is sewn up with stitching L as shown in FIG. 3(*c*).

As described in the above, the present invention provides a bag for an inflatable belt which is thin and has excellent smoothness so as to provide reduced frictional resistance with the knit cover, thereby having excellent deployment for the inflation of the inflatable belt.

A bag for an inflatable belt of the present invention is a bag for an inflatable belt capable of being inflated and has a fabric sewn in an envelope-like configuration which is woven with yarns of 315 denier or less.

Using yarns of 315 denier or less ensures that the bag is significantly thin and has excellent smoothness.

According to the present invention, it is preferable that the yarns each be made of thermoplastic synthetic filaments of 3.5 denier or less.

Additional modifications and advantages may readily appear to one skilled in the art. The invention, therefore, is not limited in to the specific details set forth herein. Accordingly, various modifications may be made without departing from the spirit or scope of the invention as defined by the appended claims and their equivalents.

This application is one of seven copending applications:

| U.S. Ser. No. | U.S. Filing Date | Our Docket No. | Japanese Application No. |
|---|---|---|---|
| Unknown | June 8, 1999 | 086142/0246 | H10-159293 |
| Unknown | June 8, 1999 | 086142/0247 | H10-159296 |
| Unknown | June 8, 1999 | 086142/0248 | H10-159295 |
| Unknown | June 8, 1999 | 086142/0249 | H10-159297 |
| Unknown | June 9, 1999 | 086142/0250 | H10-160777 |
| Unknown | June 9, 1999 | 086142/0251 | H10-160780 |
| Unknown | June 9, 1999 | 086142/0253 | H10-160778 and H10-160779 |

The instant application hereby incorporates by reference the entire specification including claims and abstract and the drawings of each of the other six applications.

What is claimed is:

1. A bag for an inflatable belt comprising a fabric woven with yarns of 315 denier or less.

2. A bag for an inflatable belt as claimed in claim 1, wherein the yarns include thermoplastic synthetic filaments of 3.5 denier or less.

3. A bag for an inflatable belt as claimed in claim 2, wherein the thermoplastic synthetic filaments are at least 2.0 denier.

4. A bag for an inflatable belt as claimed in claim 2, wherein there are 60 to 100 filaments in each yarn.

5. A bag for an inflatable belt as claimed in claim 1, wherein the fabric has a thickness of 0.20–0.25 mm.

6. A bag for an inflatable belt as claimed in claim 1, wherein the yarns are at least 100 denier.

7. A bag for an inflatable belt as claimed in claim 6, wherein the fabric is woven with a yarn of 210 to 315 filaments.

8. A method of constructing a bag for an inflatable belt, comprising:

providing a fabric bag woven with yarns of 315 denier or less, wherein the yarns include thermoplastic filaments of 3.5 denier or less;

laying the bag flat;

folding a marginal region over the bag such that approximately one-third of the flat bag remains uncovered; and folding the already folded portion over again so that the flat bag is covered.

9. A method of constructing a bag for an inflatable belt, comprising:

providing a fabric bag woven with yarns of 315 denier or less, wherein the yarns include thermoplastic filaments of 3.5 denier or less;

spreading the bag flat so that a marginal region of the bag extends in an upward direction and is perpendicular to the spread flat bag such that two side portions of the bag extend from the marginal region;

folding the side portions upward so that the marginal region is sandwiched between the two side portions; and stitching a an end portion of the folded bag.

10. A safety belt system comprising:

a webbing;

an inflatable belt connected at one end to the webbing, the inflatable belt including a bag and a cover enclosing the belt body;

a tongue having a duct communicating with the gas inlet of the inflatable belt; and a gas generator communicating with the duct of the tongue for supplying a gas into the inflatable belt to inflate the inflatable belt, wherein the bag includes a fabric woven with yarns of 100 to 315 denier; and wherein the yarns include thermoplastic synthetic filaments of 3.5 denier or less.

* * * * *